US010648228B2

(12) United States Patent
Geist et al.

(10) Patent No.: US 10,648,228 B2
(45) **Date of Patent: *May 12, 2020**

(54) SYSTEM FOR BIASING SHEET OF MATERIAL TO GATHER IN PREDETERMINED DIRECTION

(71) Applicant: Hunter Douglas Inc., Pearl River, NY (US)

(72) Inventors: Jeffery S. Geist, Arvada, CO (US); Gary E. Moss, Denver, CO (US); Galen B. Rhodes, Henderson, CO (US); Kent A. Smith, Broomfield, CO (US); Brian C. Wilson, Brighton, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/192,834

(22) Filed: Nov. 16, 2018

(65) Prior Publication Data

US 2019/0085621 A1 Mar. 21, 2019

Related U.S. Application Data

(63) Continuation of application No. 15/352,812, filed on Nov. 16, 2016, now Pat. No. 10,161,182, which is a (Continued)

(51) Int. Cl.

| | |
|---|---|
| ***E06B 9/262*** | (2006.01) |
| ***E06B 9/386*** | (2006.01) |
| *E06B 9/24* | (2006.01) |

(52) U.S. Cl.

CPC ..... *E06B 9/262* (2013.01); *E06B 9/386* (2013.01); *E06B 2009/2429* (2013.01); *E06B 2009/2622* (2013.01); *E06B 2009/2625* (2013.01)

(58) Field of Classification Search

CPC ..... E06B 2009/2622; E06B 2009/2625; E06B 2009/2627; E06B 2009/2458; (Continued)

(56) References Cited

U.S. PATENT DOCUMENTS

| | | | |
|---|---|---|---|
| 1,958,695 | A | 5/1934 | Claus |
| 2,267,869 | A | 12/1941 | Loehr |

(Continued)

FOREIGN PATENT DOCUMENTS

| | | | |
|---|---|---|---|
| EP | 0482794 | A1 | 4/1992 |
| EP | 0654577 | A1 | 5/1995 |

(Continued)

OTHER PUBLICATIONS

Author Unknown, "Poliformas Plasticas—Resinas Poliester—Fibra de Vidrio", www.poliformasplasticas.com/mx/2011/innova_laminas.php, 2010, 4 pages.

*Primary Examiner* — Johnnie A. Shablack

(57) ABSTRACT

A system for biasing or encouraging a sheet of material to gather in one direction when one edge of the sheet of material is moved toward an opposite edge of the sheet of material is provided. A plurality of strips of material may extend along a face of the sheet of material and may be laminated to the face of the sheet of material. The plurality of strips of material may overlap each other and may define stiffened regions extending along the overlapped interface between the plurality of strips of material. When the covering is moved from an extended position to a retracted position, the sheet of material may gather in loops of material that may have apexes defined at or adjacent the overlapped interfaces of the plurality of strips of material.

37 Claims, 7 Drawing Sheets

Related U.S. Application Data continuation of application No. 14/611,934, filed on Feb. 2, 2015, now Pat. No. 9,506,287.

(60) Provisional application No. 61/935,174, filed on Feb. 3, 2014.

(58) Field of Classification Search
CPC .. E06B 2009/2423; E06B 9/262; E06B 9/386; E06B 9/26
See application file for complete search history.

(56) References Cited

U.S. PATENT DOCUMENTS

| | | | | |
|---|---|---|---|---|
| RE22,311 | E | 5/1943 | Roy | |
| 2,350,200 | A | 5/1944 | Starr | |
| 2,381,542 | A | 8/1945 | Hyatt et al. | |
| 2,874,612 | A | 2/1959 | Luboshez | |
| 3,190,086 | A | 6/1965 | Klein | |
| 3,222,689 | A | 12/1965 | Efron et al. | |
| D208,350 | S | 8/1967 | Cheris | |
| 3,443,860 | A | 5/1969 | Luboshez | |
| 3,566,499 | A | 3/1971 | James | |
| 4,247,599 | A | 1/1981 | Hopper | |
| 4,282,919 | A | 8/1981 | Teno | |
| 4,378,567 | A | 3/1983 | Mir | |
| 4,842,036 | A | 6/1989 | Goodman | |
| 4,865,106 | A | 9/1989 | Wichelman | |
| 4,907,635 | A | 3/1990 | Bunger et al. | |
| 4,931,342 | A | 6/1990 | Tolbert et al. | |
| 4,974,656 | A | 12/1990 | Judkins | |
| 5,129,440 | A | 7/1992 | Colson | |
| 5,158,632 | A | 10/1992 | Colson et al. | |
| 5,184,659 | A | 2/1993 | Alcocer | |
| 5,205,333 | A | 4/1993 | Judkins | |
| 5,205,334 | A | 4/1993 | Judkins | |
| 5,228,936 | A | 7/1993 | Goodhue | |
| 5,231,708 | A | 8/1993 | Hansen | |
| 5,313,998 | A | 5/1994 | Colson et al. | |
| 5,313,999 | A | 5/1994 | Colson et al. | |
| 5,355,555 | A | 10/1994 | Zarelius | |
| 5,425,408 | A | 6/1995 | Colson | |
| 5,490,553 | A | 2/1996 | Colson et al. | |
| 5,503,210 | A | 4/1996 | Colson et al. | |
| 5,547,006 | A | 8/1996 | Auger | |
| 5,558,925 | A | 9/1996 | Fritzman | |
| 5,566,734 | A | 10/1996 | Levy et al. | |
| 5,603,368 | A * | 2/1997 | Colson | B29C 53/36 156/197 |
| 5,645,504 | A | 7/1997 | Westhoff | |
| 5,649,583 | A | 7/1997 | Hsu | |
| 5,680,891 | A | 10/1997 | Prince | |
| 5,692,550 | A | 12/1997 | Ford et al. | |
| 5,714,034 | A | 2/1998 | Goodhue | |
| 5,733,632 | A | 3/1998 | Marusak | |
| 5,746,266 | A | 5/1998 | Colson et al. | |
| 5,787,951 | A | 8/1998 | Tonomura et al. | |
| 5,855,235 | A | 1/1999 | Colson et al. | |
| 5,897,731 | A | 4/1999 | Colson et al. | |
| 5,918,655 | A | 7/1999 | Corey | |
| 5,960,847 | A | 10/1999 | Crider et al. | |
| 6,006,812 | A | 12/1999 | Corey | |
| 6,103,336 | A | 8/2000 | Swiszcz | |
| 6,112,797 | A | 9/2000 | Colson et al. | |
| 6,223,802 | B1 | 5/2001 | Colson | |
| D443,455 | S | 6/2001 | Hynniman | |
| 6,289,964 | B1 | 9/2001 | Colson et al. | |
| 6,345,486 | B1 | 2/2002 | Colson et al. | |
| 6,378,567 | B1 | 4/2002 | Chen | |
| 6,416,842 | B1 | 7/2002 | Swiszcz et al. | |
| 6,484,786 | B1 | 11/2002 | Ruggles et al. | |
| 6,497,264 | B1 | 12/2002 | Paskevicius | |
| D468,950 | S | 1/2003 | Judkins | |
| 6,572,725 | B2 | 6/2003 | Goodhue | |
| 6,595,262 | B2 | 7/2003 | Chen | |
| 6,662,845 | B1 | 12/2003 | Palmer | |
| 6,688,373 | B2 | 2/2004 | Corey et al. | |
| 6,740,389 | B2 | 5/2004 | Yu | |
| 6,792,994 | B2 | 9/2004 | Lin | |
| 6,932,138 | B2 | 8/2005 | Yu et al. | |
| 6,978,821 | B2 | 12/2005 | Welfonder | |
| 6,982,020 | B2 | 1/2006 | Swiszcz et al. | |
| 6,988,526 | B2 | 1/2006 | Judkins | |
| D515,345 | S | 2/2006 | Herhold et al. | |
| 7,059,381 | B2 | 6/2006 | Chen | |
| 7,111,659 | B2 | 9/2006 | Harper et al. | |
| 7,117,917 | B2 | 10/2006 | Allsopp | |
| 7,147,029 | B2 | 12/2006 | Kovach et al. | |
| 7,159,634 | B1 | 1/2007 | Judkins | |
| 7,191,816 | B2 | 3/2007 | Colson et al. | |
| 7,207,370 | B2 | 4/2007 | Snyder et al. | |
| 7,237,591 | B2 | 7/2007 | Snyder et al. | |
| 7,311,131 | B2 | 12/2007 | Mien et al. | |
| 7,337,822 | B2 | 3/2008 | Snyder et al. | |
| D568,082 | S | 5/2008 | Bohlen | |
| 7,500,505 | B2 | 3/2009 | Smith et al. | |
| 7,549,455 | B2 | 6/2009 | Harper et al. | |
| 7,571,756 | B2 * | 8/2009 | Smith | E06B 9/262 160/121.1 |
| 7,578,334 | B2 | 8/2009 | Smith et al. | |
| 7,588,068 | B2 | 9/2009 | Colson et al. | |
| 7,617,859 | B2 | 11/2009 | Auger | |
| D605,885 | S | 12/2009 | Judkins | |
| 7,637,301 | B2 | 12/2009 | Forst Randle | |
| 7,730,931 | B2 | 6/2010 | Stern | |
| D622,964 | S | 9/2010 | Colson | |
| D623,419 | S | 9/2010 | Swiszcz et al. | |
| D632,492 | S | 2/2011 | Colson et al. | |
| D632,493 | S | 2/2011 | Colson et al. | |
| D640,472 | S | 6/2011 | Colson et al. | |
| D640,875 | S | 7/2011 | Colson et al. | |
| 7,971,624 | B2 | 7/2011 | Harper et al. | |
| 7,975,747 | B2 | 7/2011 | Liang et al. | |
| 8,020,602 | B2 | 9/2011 | Smith et al. | |
| D651,438 | S | 1/2012 | Lin | |
| 8,151,857 | B2 | 4/2012 | Colson et al. | |
| 8,171,640 | B2 | 5/2012 | Colson et al. | |
| 8,261,807 | B2 | 9/2012 | Dann et al. | |
| D668,090 | S | 10/2012 | Colson et al. | |
| 8,393,080 | B2 | 3/2013 | Ballard, Jr. et al. | |
| 8,496,768 | B2 | 7/2013 | Holt et al. | |
| D691,397 | S | 10/2013 | Colson et al. | |
| D692,684 | S | 11/2013 | Colson et al. | |
| 8,607,838 | B2 | 12/2013 | Colson et al. | |
| 8,905,114 | B1 | 12/2014 | Whitaker | |
| 8,944,133 | B2 * | 2/2015 | Colson | E06B 9/262 160/84.05 |
| 8,944,134 | B2 * | 2/2015 | Ballard, Jr. | E06B 9/266 160/121.1 |
| 8,967,224 | B2 | 3/2015 | Foley et al. | |
| 9,016,346 | B2 | 4/2015 | Cha | |
| D728,267 | S | 5/2015 | Cha | |
| 9,080,377 | B2 | 7/2015 | Holt et al. | |
| 9,328,552 | B2 | 5/2016 | Dann et al. | |
| 9,359,812 | B2 | 6/2016 | Lin | |
| 9,506,287 | B2 * | 11/2016 | Giest | E06B 9/262 |
| D773,208 | S | 12/2016 | Lin | |
| 9,540,874 | B2 | 1/2017 | Colson et al. | |
| 9,719,295 | B2 | 8/2017 | Lin | |
| 9,850,702 | B2 | 12/2017 | Ballard, Jr. et al. | |
| 9,995,083 | B2 * | 6/2018 | Colson | E06B 9/34 |
| 10,030,444 | B2 * | 7/2018 | Colson | E06B 9/34 |
| 10,145,172 | B2 * | 12/2018 | Colson | E06B 9/34 |
| 10,161,182 | B2 * | 12/2018 | Giest | E06B 9/262 |
| 2002/0040770 | A1 * | 4/2002 | Colson | B29C 53/40 160/236 |
| 2004/0079492 | A1 | 4/2004 | Lin | |
| 2005/0087309 | A1 | 4/2005 | Nien et al. | |
| 2005/0155722 | A1 | 7/2005 | Colson et al. | |
| 2005/0167057 | A1 | 8/2005 | Nien | |
| 2005/0205217 | A1 | 9/2005 | Harper et al. | |
| 2006/0157204 | A1 | 7/2006 | Lin | |
| 2006/0191646 | A1 | 8/2006 | Harper et al. | |
| 2007/0010147 | A1 | 1/2007 | Swiszcz | |

(56) References Cited

U.S. PATENT DOCUMENTS

| | | | | |
|---|---|---|---|---|
| 2007/0039699 | A1 | 2/2007 | Colson et al. | |
| 2007/0074826 | A1 | 4/2007 | Jelic et al. | |
| 2008/0066277 | A1 | 3/2008 | Colson et al. | |
| 2008/0149280 | A1 | 6/2008 | Smith et al. | |
| 2008/0168637 | A1 | 7/2008 | Ballard et al. | |
| 2008/0173409 | A1 | 7/2008 | Robertson et al. | |
| 2008/0230189 | A1 | 9/2008 | Rossato et al. | |
| 2010/0051209 | A1 | 3/2010 | Liang et al. | |
| 2010/0059186 | A1* | 3/2010 | Colson | E06B 9/262 160/84.01 |
| 2010/0147468 | A1 | 6/2010 | Liang et al. | |
| 2010/0186903 | A1 | 7/2010 | Liang et al. | |
| 2010/0252209 | A1 | 10/2010 | Wang | |
| 2011/0126959 | A1 | 6/2011 | Holt et al. | |
| 2011/0126990 | A1 | 6/2011 | Huang | |
| 2012/0132373 | A1 | 5/2012 | Lin | |
| 2012/0193037 | A1* | 8/2012 | Sengelaub | E06B 9/262 160/84.02 |
| 2012/0193040 | A1 | 8/2012 | Colson et al. | |
| 2013/0032301 | A1 | 2/2013 | Lin | |
| 2013/0056160 | A1 | 3/2013 | Dann et al. | |
| 2013/0139977 | A1 | 6/2013 | Ballard, Jr. et al. | |
| 2013/0180669 | A1 | 7/2013 | Judkins | |
| 2013/0240158 | A1 | 9/2013 | Chen | |
| 2014/0053989 | A1 | 2/2014 | Colson et al. | |
| 2014/0096915 | A1 | 4/2014 | Colson et al. | |
| 2015/0218880 | A1 | 8/2015 | Giest et al. | |
| 2016/0356080 | A1 | 12/2016 | Colson et al. | |
| 2017/0306694 | A1 | 10/2017 | Hsu et al. | |
| 2018/0002978 | A1 | 1/2018 | Colson et al. | |
| 2018/0094478 | A1 | 4/2018 | Judkins | |
| 2018/0094479 | A1* | 4/2018 | Ballard, Jr. | E06B 9/266 |
| 2018/0209211 | A1* | 7/2018 | Rupel | E06B 9/262 |
| 2018/0216402 | A1* | 8/2018 | Lynch | E06B 9/24 |
| 2018/0291683 | A1* | 10/2018 | Colson | E06B 9/34 |
| 2018/0298688 | A1* | 10/2018 | Colson | E06B 9/34 |
| 2019/0085621 | A1* | 3/2019 | Geist | E06B 9/262 |

FOREIGN PATENT DOCUMENTS

| | | | | |
|---|---|---|---|---|
| EP | 1213435 | A2 | 6/2002 | |
| GB | 1494842 | A | 12/1977 | |
| JP | 6173549 | A | 6/1994 | |
| JP | 7039449 | A | 2/1995 | |
| JP | 9221969 | | 8/1997 | |
| TW | 549344 | U | 8/2003 | |
| WO | 198502760 | A1 | 7/1985 | |
| WO | 199429559 | A1 | 12/1994 | |
| WO | 2005019584 | A2 | 3/2005 | |
| WO | 2005062875 | A2 | 7/2005 | |
| WO | 2005081948 | A2 | 9/2005 | |
| WO | 2006022697 | A2 | 3/2006 | |
| WO | 2006023751 | A2 | 3/2006 | |
| WO | 2006098853 | A2 | 9/2006 | |
| WO | WO-2012142519 | A1 * | 10/2012 | E06B 9/34 |

* cited by examiner

SYSTEM FOR BIASING SHEET OF MATERIAL TO GATHER IN PREDETERMINED DIRECTION

CROSS-REFERENCE TO RELATED APPLICATIONS

This application is a continuation of co-pending U.S. patent application Ser. No. 15/352,812, filed Nov. 16, 2016, entitled "System For Biasing Sheet of Material to Gather in Predetermined Direction", which application is a continuation of U.S. patent application Ser. No. 14/611,934, filed Feb. 2, 2015, now U.S. Pat. No. 9,506,287, entitled "System For Biasing Sheet of Material to Gather in Predetermined Direction", which claims priority under 35 U.S.C. § 119(e) to, and the benefit of, U.S. provisional patent application No. 61/935,174, filed Feb. 3, 2014, and entitled "System For Biasing Sheet of Material to Gather in Predetermined Direction", which are all hereby incorporated by reference into the present application in their entireties.

This application is related to U.S. nonprovisional patent application Ser. No. 13/636,292, filed Oct. 30, 2012, and entitled "System For Biasing Fabric to Gather in Predetermined Direction", which application is a national stage entry of international application No. PCT/US2011/027681, filed Mar. 9, 2011, and entitled "System For Biasing Fabric to Gather in Predetermined Direction," which application claims priority under 35 U.S.C. § 119(e) to U.S. provisional patent application No. 61/316,572, filed Mar. 23, 2010, and entitled "System For Biasing Fabric to Gather in Predetermined Direction."

BACKGROUND

1. Field

The present disclosure is directed generally to a covering for an architectural opening having a gatherable sheet of material and more particularly to a system for biasing the sheet of material to gather in a predetermined direction when the covering is retracted.

2. Related Art

Coverings for architectural openings, such as windows, doors, archways, and the like, have taken numerous forms for many years. Some coverings include a retractable sheet of material that is moveable between an extended position and a retracted position. In the extended position, the sheet of material may be positioned across the opening and may be disposed in a substantially flat, planar orientation. During retraction, one edge of the sheet of material may be moved toward an opposing edge of the sheet of material, generally resulting in the sheet of material being stacked or gathered about a moveable rail.

SUMMARY

Examples of the disclosure may include a covering for an architectural opening. The covering may include a head rail, a bottom rail, a support sheet of flexible material extending from the head rail to the bottom rail and configured to hang in a substantially flat, vertical plane when the covering is in a fully extended position, and a plurality of overlapping strips of material extending horizontally along the rear face of the support sheet. The support sheet may have a front face and a rear face, and the plurality of strips of material may be laminated to the rear face of the support sheet. When the covering is moved from the extended position to the retracted position, the support sheet may gather in loops of material that are rearwardly-directed and have apexes defined along or adjacent the overlaps of the plurality of strips of material. In some examples, the support, the plurality of strips of material, or both are formed of a light blocking material.

In some examples, the covering may include a front sheet of flexible material attached to the front face of the support sheet along a set of vertically-spaced lines of attachment. The vertically-spaced lines of attachment may be disposed between the overlaps of the plurality of strips of material. The set of vertically-spaced lines of attachment may be positioned equidistant between the overlaps of the plurality of strips of material. The front sheet forms horizontally-extending, vertically-spaced loops of material.

In some examples, the covering may include a set of lift elements extending from the head rail to the bottom rail and disposed between the support sheet and the front sheet. The lift element may be operative to raise the bottom rail toward the head rail. The set of vertically-spaced lines of attachment may be intermittent along their length to define vertically-aligned gaps through which the set of lift elements slidably pass.

In some examples, a method of assembling a covering for an architectural opening is provided. The method may include attaching a plurality of strips of material to a rear face of a substantially flat, planar support sheet along a first set of lines of attachment disposed at vertically-spaced intervals; attaching a front sheet of material to a front face of the support sheet along a second set of lines of attachment disposed at vertically-spaced intervals, wherein the second set of lines of attachment are vertically offset from the first set of lines of attachment; raising a lower edge of the support sheet; and stacking the support sheet in rearwardly-directed loops of material folded along the first set of lines of attachment as the lower edge is raised.

In some examples, the method further may include attaching an upper edge of each strip of material of the plurality of strips of material to the support sheet with the first set of lines of attachment. In some examples, the method further may include overlapping a lower edge of each strip of material of the plurality of strips of material with an upper edge of an immediately subjacent strip of material of the plurality of strips of material. In some examples, the method further may include attaching the lower edge of each strip of material of the plurality of strips of material to the upper edge of the immediately subjacent strip of material of the plurality of strips of material. In some examples, the attaching the lower edge to the upper edge comprises attaching the lower edge of each strip of material of the plurality of strips of material to the upper edge of the immediately subjacent strip of material of the plurality of strips of material with an adhesive bead that is vertically aligned with one of the first set of lines of attachment.

In some examples, the method further may include forming the front sheet into cascading loops of material. In some examples, the method further may include positioning a lift element in a gap defined at the second set of lines of attachment between the support sheet and the front sheet.

In some examples, a covering for an architectural opening is provided. The covering may include a first sheet of flexible material and multiple strips of material extending along a width dimension of the first sheet. The first sheet may have a front face and a rear face, and the multiple strips of material may be attached to and contiguous with the rear face of the first sheet. The multiple strips of material may overlap one another to form stiffened regions spaced apart from one another along a length dimension of the first sheet. The covering may include a second sheet of flexible material attached to the front face of the first sheet along a set of vertically-spaced lines of attachment. The set of vertically-spaced lines of attachment may be disposed vertically between the stiffened regions. The set of vertically-spaced lines of attachment may be positioned equidistant between the stiffened regions. The front sheet may form horizontally-extending, vertically-spaced loops of material.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of examples, it should be appreciated that individual aspects of any example can be claimed separately or in combination with aspects and features of that example or any other example.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

Figure 1:
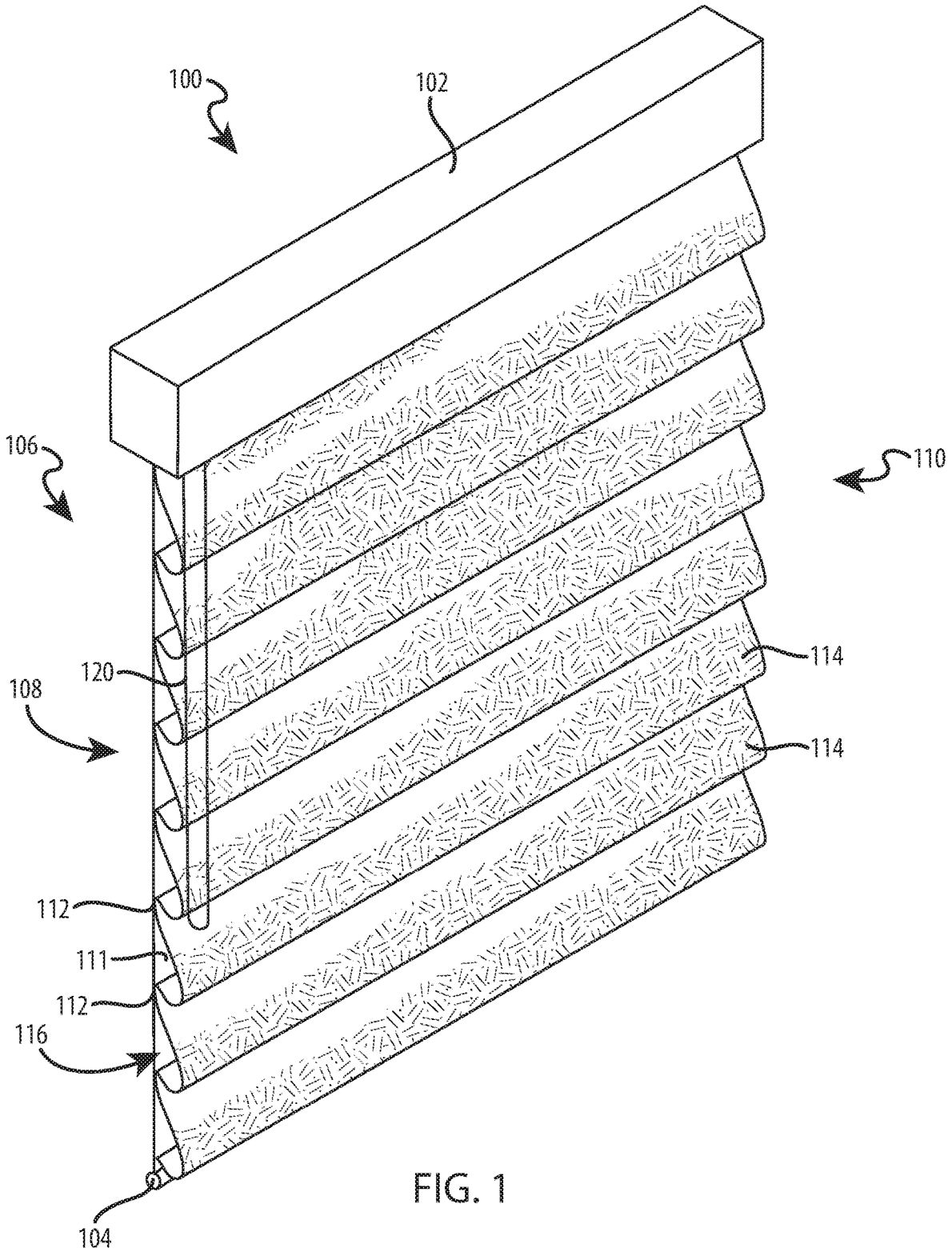
FIG. 1 is a front isometric view of a covering for an architectural opening in a fully-extended position in accordance with some embodiments of the present disclosure.

It should be understood that the drawings are not necessarily to scale. In certain instances, details that are not necessary for an understanding of the disclosure or that render other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. It should be understood that the claimed subject matter is not necessarily limited to the particular examples or arrangements illustrated herein.

DETAILED DESCRIPTION

Examples of the disclosure may provide a retractable covering for an architectural opening, such as an archway, a door, a window, and the like. The covering may include a sheet of flexible material, such as a fabric, that is biased or encouraged to gather or stack in one predetermined direction when one edge of the sheet of material is moved toward an opposite edge of the sheet of material. The biased configuration of the sheet of material may result in a predictable stacking of the sheet of material during retraction of the covering, which may facilitate the operability of the covering, the aesthetics of the covering, or both.

The sheet of material may include stiffened areas or battens that extend generally parallel to opposing edges of the sheet of material that are moved toward one another during retraction of the covering. The stiffened areas may be spaced vertically apart from each other at uniform intervals along a face of the sheet of material. In some examples, multiple strips of material or vanes are attached to a face of the sheet of material that faces the direction in which the gathering is desired. The strips of material may be formed as elongated rectangular strips of material extending lengthwise along a length dimension of the sheet of material (the length of the sheet of material is defined by the shortest distance between upper and lower edges of the sheet of material) and widthwise along a width dimension of the sheet of material (the width of the sheet of material is defined by the shortest distance between opposing side edges of the sheet of material). In some examples, the strips of material are laminated to the face of the sheet of material so that the strips of material are coextensive with the sheet of material and move in unison with the sheet of material. The strips of material may be disposed in parallel relationship with each other and with the opposing edges of the sheet of material that are moved toward one another during retraction of the covering.

The strips of material may be configured to bias the sheet of material in a rearward direction (e.g., towards a window) upon retraction of the covering. The rearward bias may ensure the sheet of material gathers uniformly in a rearward direction to avoid malfunctioning of the covering, as well as to provide more uniform and predictable aesthetics when the covering is retracted. In some examples, one or more lift elements may be positioned along a forwardly-directed face of the sheet of material (e.g., along a room-side of the sheet of material), and thus the rearwardly-directed bias of the sheet of material may ensure the sheet of material does not interfere with the operation of the lift elements during retraction of the covering.

The strips of material may overlap one another. The overlapping configuration of the strips of material may stiffen the sheet of material along the overlapped portions of the strips of material. The overlapped portions of the strips of material may be attached to one another and may bias the sheet of material to bend or fold rearwardly at vertically-spaced intervals generally corresponding to the vertical locations of the overlapped portions of the strips of material, thereby facilitating predictable stacking of the sheet of material. During retraction of the covering, the strips of material and the sheet of material may together form droops or loops of material that extend in a rearwardly direction. The overlapped portions of the strips of material may be disposed at the apexes or tips of the loops of material.

The sheet of material, the strips of material, or both may have light blocking characteristics, light dimming characteristics, or any other light transmissivity characteristics. In some examples, the sheet of material, the strips of material, or both are light blocking, resulting in a stacking blackout shade. In some examples, one or both faces of the strips of material may be metallized or coated with a light-blocking material.

A face material may be attached to an opposing face of the sheet of material relative to the strips of material. The face material may form cascading droops or loops of material, which may extend forwardly and downwardly from the sheet of material when the covering is in a fully-extended position. The face material may be attached to the sheet of material along lines of attachment extending generally parallel to the strips of material and to the opposing edges of the sheet of material that are moved toward one another during retraction of the covering. The lines of attachment may be disposed between the vertically-spaced overlapping portions of the strips of material. In some examples, the lines of attachment are centered between the vertically-spaced overlapping portions of the strips of material. During retraction of the covering, the loops of material of the face material may bias the face material in a forwardly direction (e.g., towards an associated room), generally opposite to the rearwardly-biased direction of the strips of material.

Figure 2:
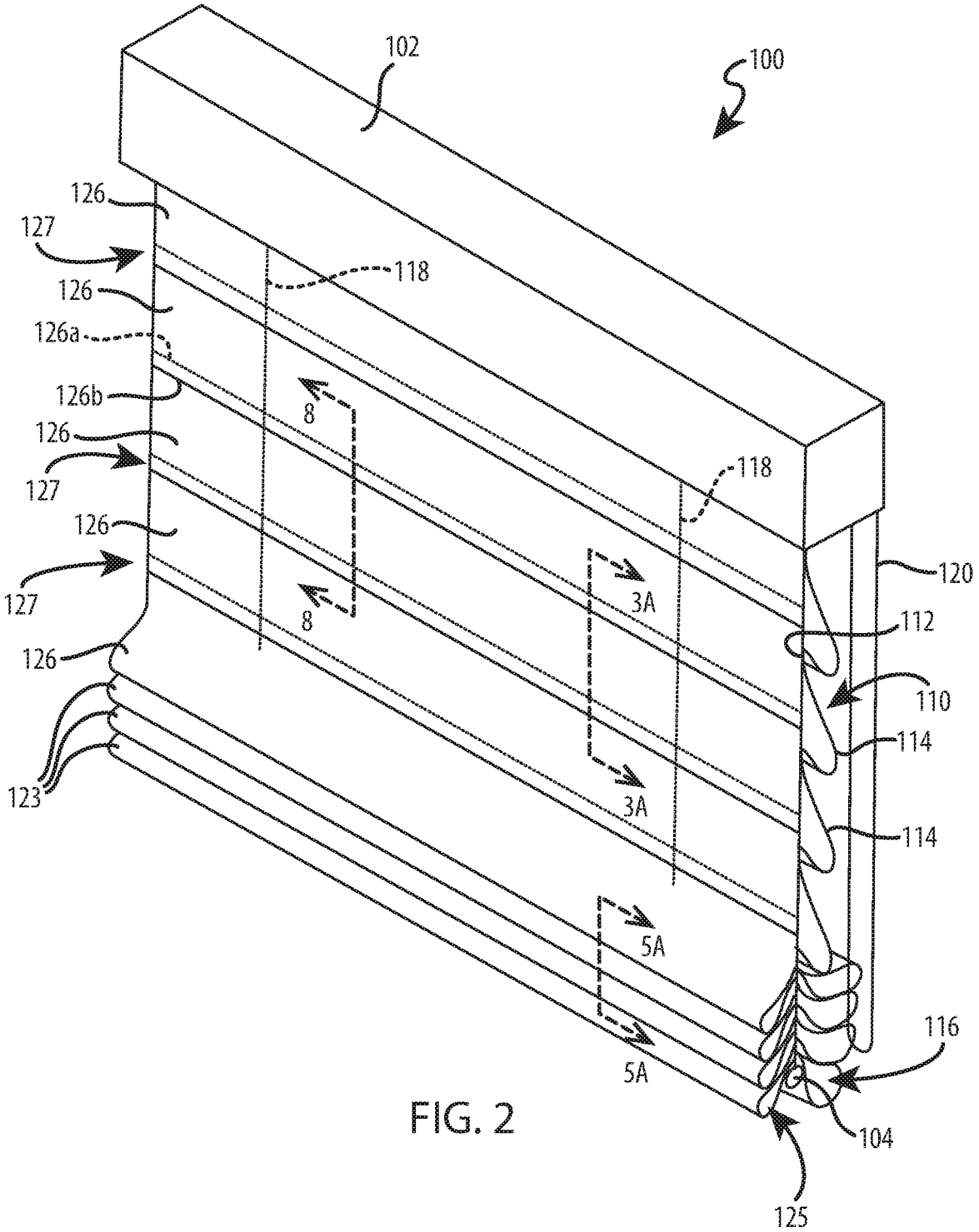
FIG. 2 is a rear isometric view of the covering of FIG. 1 showing the covering in a partially-retracted position in accordance with some embodiments of the present disclosure.

Referring to FIGS. 1 and 2, a retractable covering 100 for an architectural opening is provided. The covering 100 may include a head rail 102, a bottom rail 104, and a shade 106 extending between the head rail 102 and the bottom rail 104. The shade 106 may include a rear layer 108 and a front layer 110. The rear layer 108 may be attached along an upper edge to the head rail 102 and attached along a lower edge to the bottom rail 104, which may function as a ballast to maintain the rear layer 108 in a taut condition. A length dimension of the rear layer 108 may extend from the head rail 102 to the bottom rail 104 in a direction generally orthogonal to the head rail 102 and the bottom rail 104. A width dimension of the rear layer 108 may extend from one side of the rear layer to an opposing side of the rear layer in a direction generally parallel to the head rail 102 and the bottom rail 104.

With continued reference to FIGS. 1 and 2, the front layer 110 may be attached to a face 111 of the rear layer 108 along lines of attachment 112, which may extend along the width dimension of the rear layer 108. The lines of attachment 112 may be vertically-separated from, and generally parallel to, one another. The length of the front layer 110 defined between subsequent lines of attachment 112 may be longer than the length of the rear layer 108 defined between the same subsequent lines of attachment 112 so that the front layer 110 forms droops or loops of material 114 that extend widthwise across the face 111 of the rear layer 108. The loops of material 114 may extend forwardly and downwardly from the lines of attachment 112 and may define a vertical column or stack of horizontally-extending cells 116 between the layers 108, 110. The loops of material 114 may provide a uniform, cascading appearance and may overlap one another. The loops of material 114 may have a tear-drop shaped profile. The layers 108, 110 may be constructed of continuous lengths of material or may be constructed of strips of material attached or joined together in an edge-to-edge, overlapping, or other suitable relationship. In some examples, the shade 106 is a Roman shade.

As shown in FIGS. 1 and 2, the shade 106 may be moveable between extended and retracted positions. To retract the shade 106 from the fully-extended position of FIG. 1 to the partially-retracted position of FIG. 2, the covering 100 may include a set of lift elements 118, such as lift cords, lift straps, or any other suitable lift element or mechanism. The lift elements 118 may be operatively coupled to the head rail 102 and the bottom rail 104 to raise the bottom rail 104 toward the head rail 102. A lower end of the lift elements 118 may be attached to the bottom rail 104, and an upper end of the lift elements 118 may be operatively coupled to a drive mechanism to change the effective length of the lift elements 118 extending between the head rail 102 and the bottom rail 104. Example drive mechanisms may include an electrical motor, a spring, an operating element 120 (such as a cord or ball chain) coupled to a spool, or any other suitable drive element or mechanism.

Figure 8:
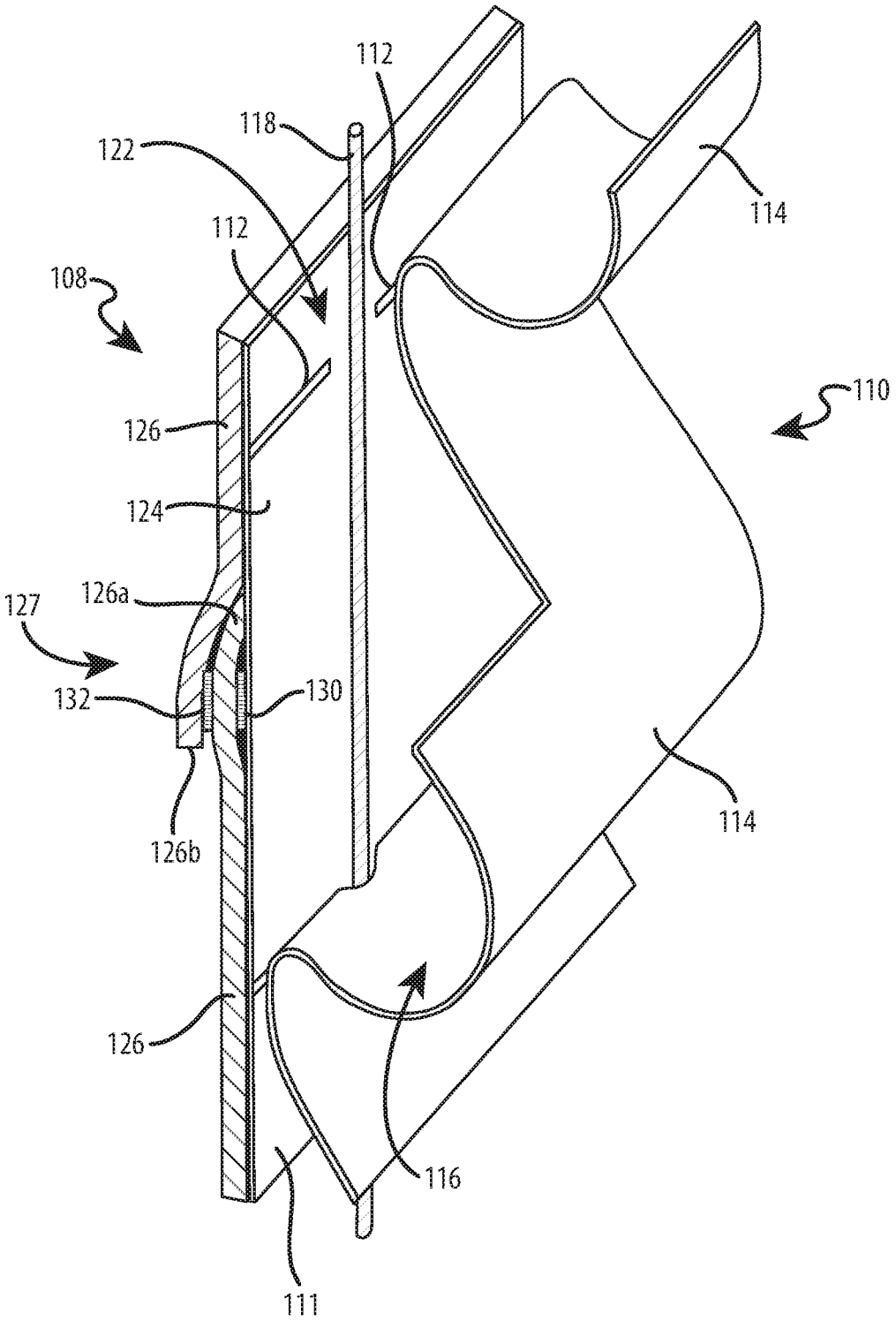
FIG. 8 is a diagrammatic, front isometric view of the covering of FIG. 1 taken along line 8-8 in FIG. 2 with a portion of the covering removed to illustrate a lift cord slideably positioned between a front layer and a rear layer of the covering in accordance with some embodiments of the present disclosure.

Referring to FIG. 8, the lift elements 118 may extend downwardly from the head rail 102 in a slideable path defined between the rear and front layers 108, 110 of the shade 106. As shown in FIG. 8, the front layer 110 may be secured intermittently to the rear layer 108 along the horizontal lines of attachment 112 to define vertically-aligned gaps 122 between the layers 108, 110 through which the lift elements 118 may slide. During extension of the shade 106, the lift elements 118 may slide downwardly through the gaps 122 relative to the layers 108, 110 to lower the bottom rail 104 away from the head rail 102. During retraction of the shade 106, the lift elements 118 may slide upwardly through the gaps 122 relative to the layers 108, 110 to raise the bottom rail 104 toward the head rail 102.

Figure 5B:
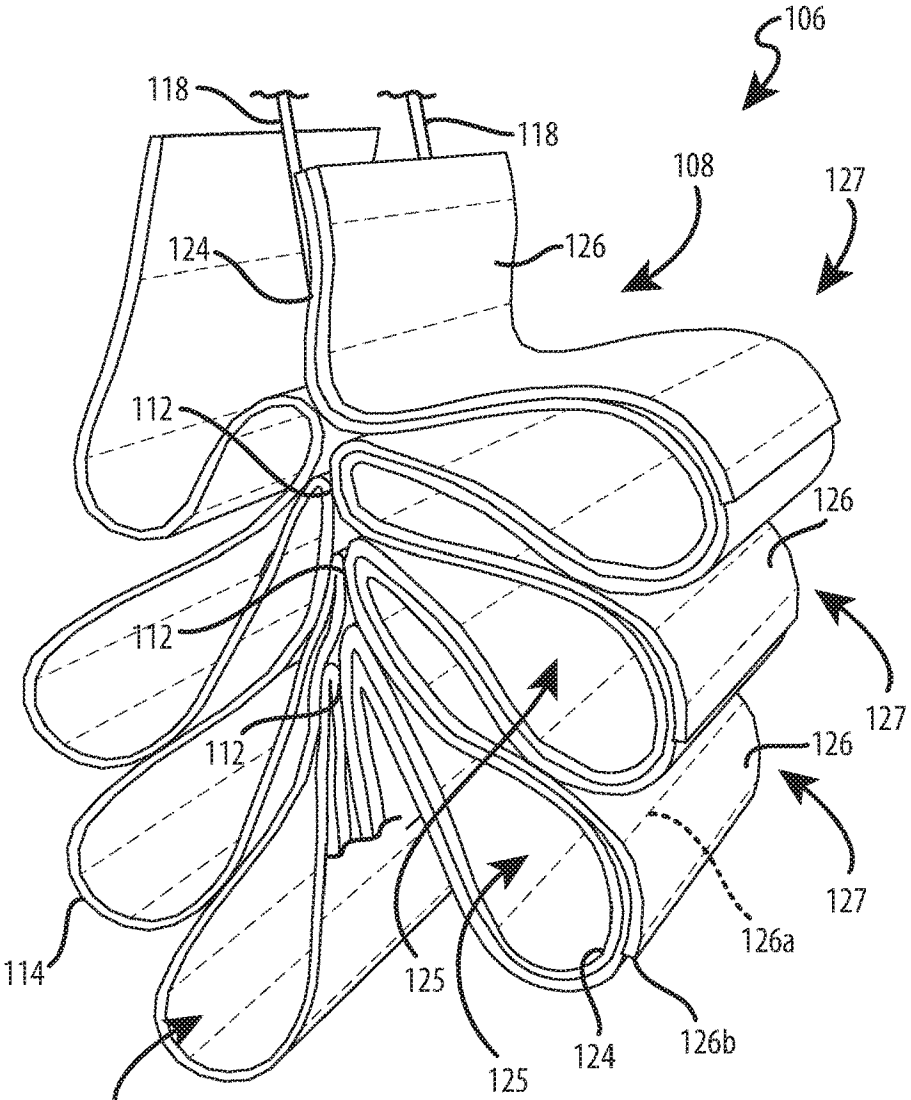
FIG. 5B is an enlarged, fragmentary isometric view of a gathered portion of the covering of FIG. 2 in accordance with some embodiments of the present disclosure.
Figure 5A:
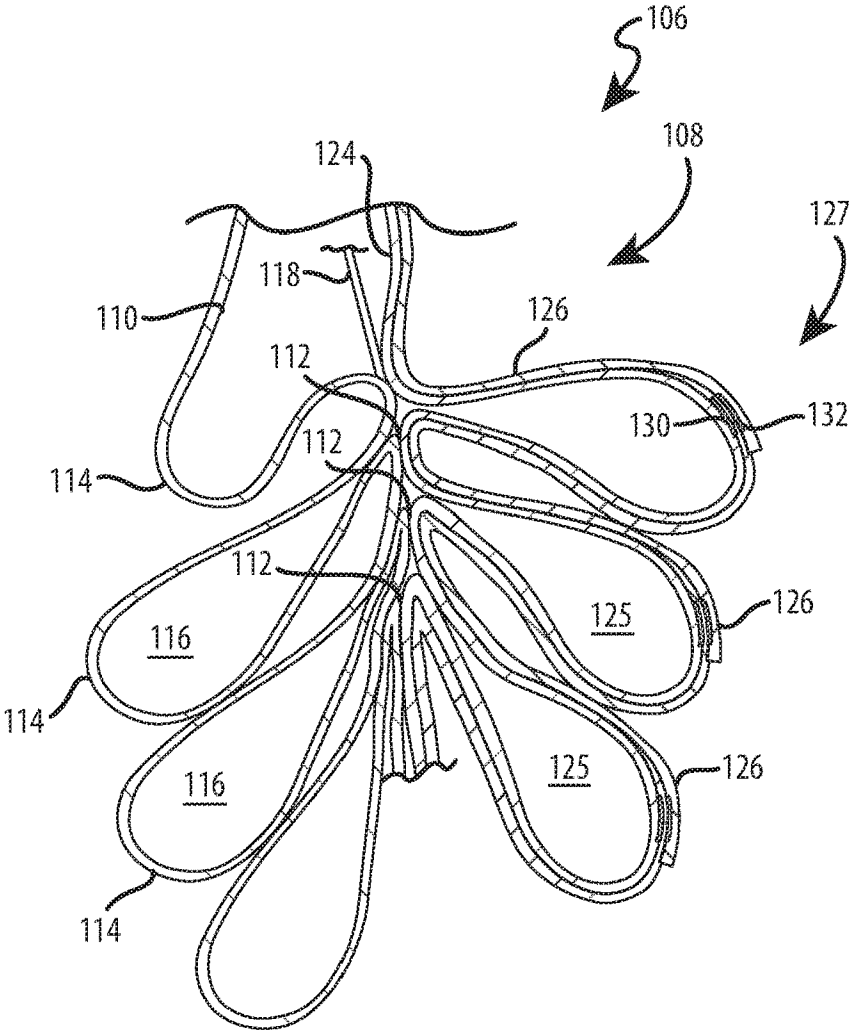
FIG. 5A is an enlarged, fragmentary cross-sectional view of a gathered portion of the covering of FIG. 1 taken along line 5A-5A of FIG. 2 in accordance with some embodiments of the present disclosure.

Referring to FIGS. 2 and 5A-5B, the rear and front layers 108, 110 may be gathered on the bottom rail 104 in opposing directions during retraction of the shade 106. The rear layer 108 may be gathered on the bottom rail 104 in a rearwardly direction, and the front layer 110 may be gathered on the bottom rail 104 in a forwardly direction. The rear layer 108 of the shade 106 may form rearwardly-directed droops or loops of material 123. The loops of material 123 may define a vertical column of horizontally-extending cells 125, which may be horizontally offset from the cells 116 defined by the loops of material 114 of the front layer 110.

Figure 4B:
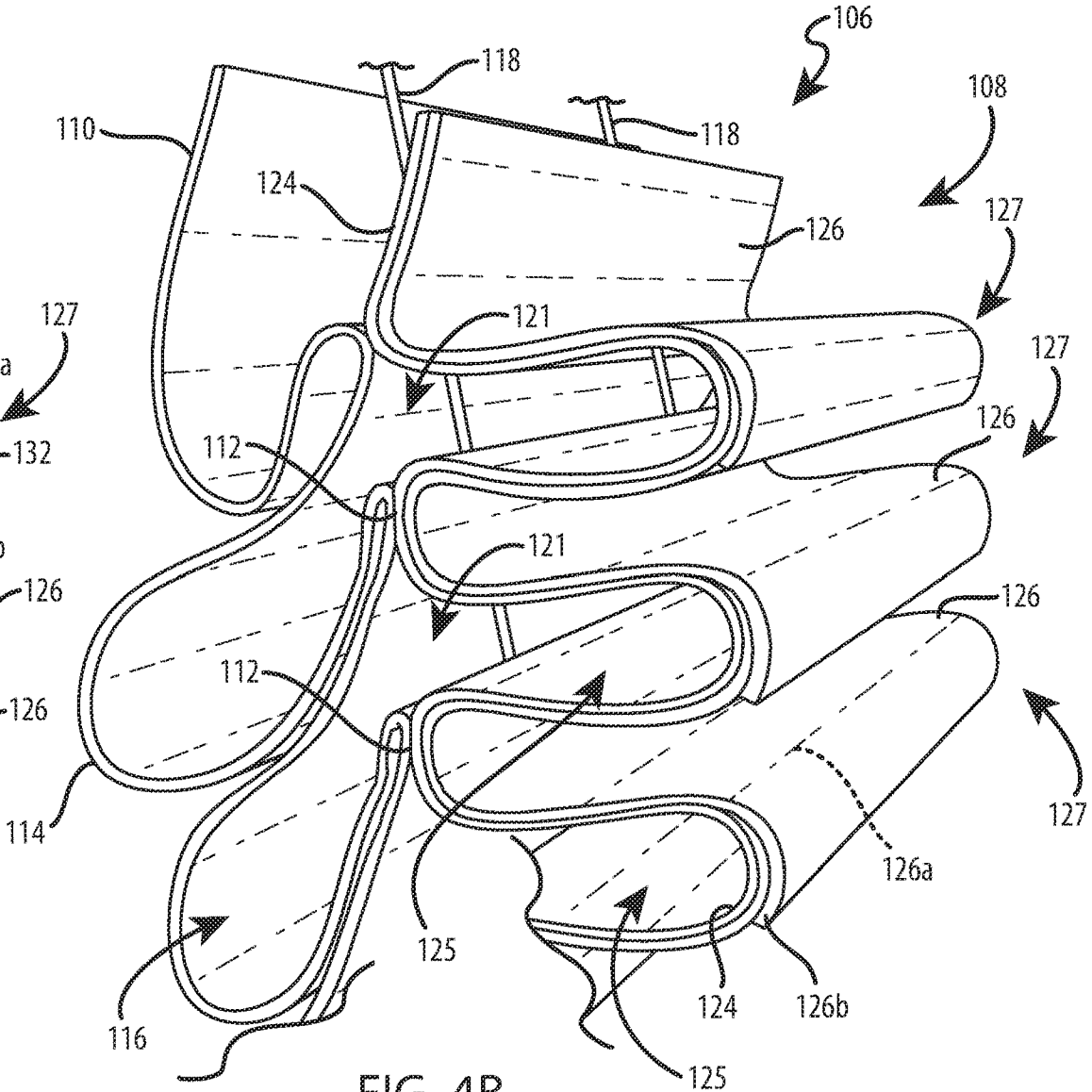
FIG. 4B is an enlarged, fragmentary isometric view of a partially collapsed portion of the covering of FIG. 2 in accordance with some embodiments of the present disclosure.
Figure 4A:
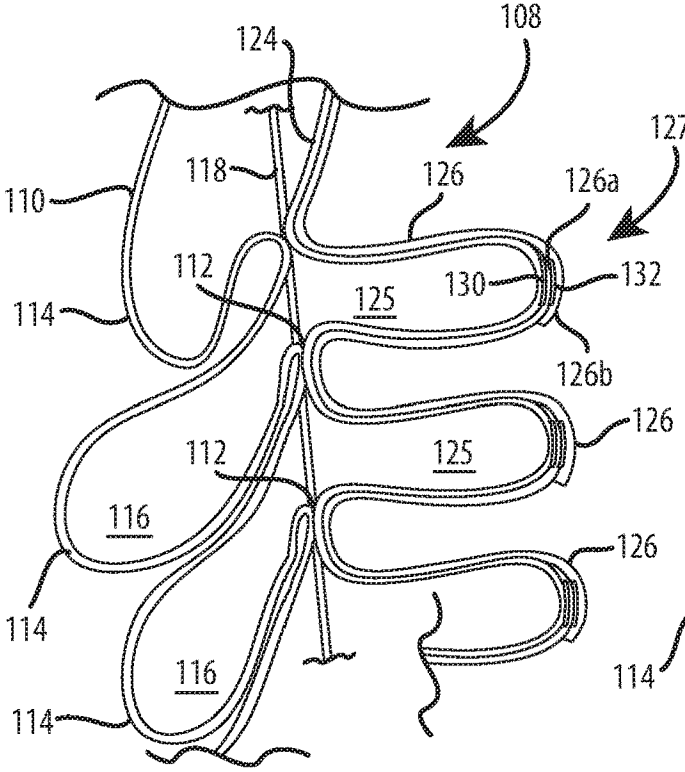
FIG. 4A is an enlarged, fragmentary side view of a partially collapsed portion of the covering of FIG. 2 in accordance with some embodiments of the present disclosure.

As shown in FIGS. 4A and 4B, the cells 125 of the rear layer 108 may be in fluid communication with the cells 116 of the front layer 110 when the shade 106 is partially collapsed. The open interfaces 121 between respective cells 116, 125 may be aligned with one another along a vertical centerline of the shade 106. When the shade 106 is in a partially collapsed position, the lines of attachment 112 of the front layer 110 to the rear layer 108 may be aligned with one another and with the open interfaces 121 (see FIG. 4A). The lines of attachment 112 may alternate with the open interfaces 121 from the bottom rail 104 toward the head rail 102. In other words, when the shade 106 is in a partially collapsed position (see FIGS. 4A and 4B), the lines of attachment 112 may be spaced vertically apart from one another by the open interfaces 121 of the cells 116, 125. As the bottom rail 104 moves towards the head rail 102 due to retraction of the lift elements 118, the lines of attachment 112 may gather on top of one another and close or reduce the size of the open interfaces 121 between the cells 116, 125 (see FIGS. 5A and 5B). When the shade 106 is in a gathered position (see FIGS. 5A and 5B), the lines of attachment 112 may be aligned with one another, and the lowermost line of attachment 112 may be gathered on the bottom rail 104. The lines of attachment 112 may be aligned with or not aligned with a vertical centerline of the bottom rail 104.

The front layer 110 may be biased forwardly to ensure the front layer 110 gathers in a forwardly direction. For example, the front layer 110 may stack in the forwardly direction due at least in part to the forwardly extension of the loops of material 114. As the bottom rail 104 is raised upwardly in a substantially vertical direction, the loops of material 114 may remain in a forwardly position relative to the bottom rail 104 and thus may be gathered on the bottom rail 104 in a forwardly-directed configuration (see FIGS. 2 and 5A-5B).

The rear layer 108 may be biased rearwardly to ensure the rear layer 108 gathers in a rearwardly direction. For example, the rear layer 108 may be biased to bend or fold in a rearwardly direction during retraction of the shade 106 and thus may be gathered on the bottom rail 104 in a rearwardly-directed configuration (see FIGS. 2 and 5A-5B). The rearwardly bias of the rear layer 108 may ensure the rear layer 108 does not interfere with the functioning of the covering 100, such as the operation of the lift elements 118, or the aesthetics of the front layer 110, during extension or retraction.

Referring to FIGS. 2-5B, the rear layer 108 may include stiffened portions or regions 127, which may be referred to as battens or stays. The stiffened regions 127 of the rear layer 108 may be spaced vertically apart from each other at uniform intervals. The stiffened areas 127 may extend generally parallel to the bottom rail 104. The stiffened regions 127 may have increased rigidity or stiffness relative to the portions of the rear layer 108 disposed between the stiffened regions 127, thereby biasing the rear layer 108 to bend or fold along the edges of the stiffened regions 127 so that the stiffened regions 127 are disposed at the apexes or at the tips of the loops of material 123 of the rear layer 108 when the rear layer 108 is gathered on the bottom rail 104. The stiffened regions 127 may cause localized bending or a hinge structure along the edges of the stiffened regions 127 extending along the width dimension of the rear layer 108.

Figure 3B:
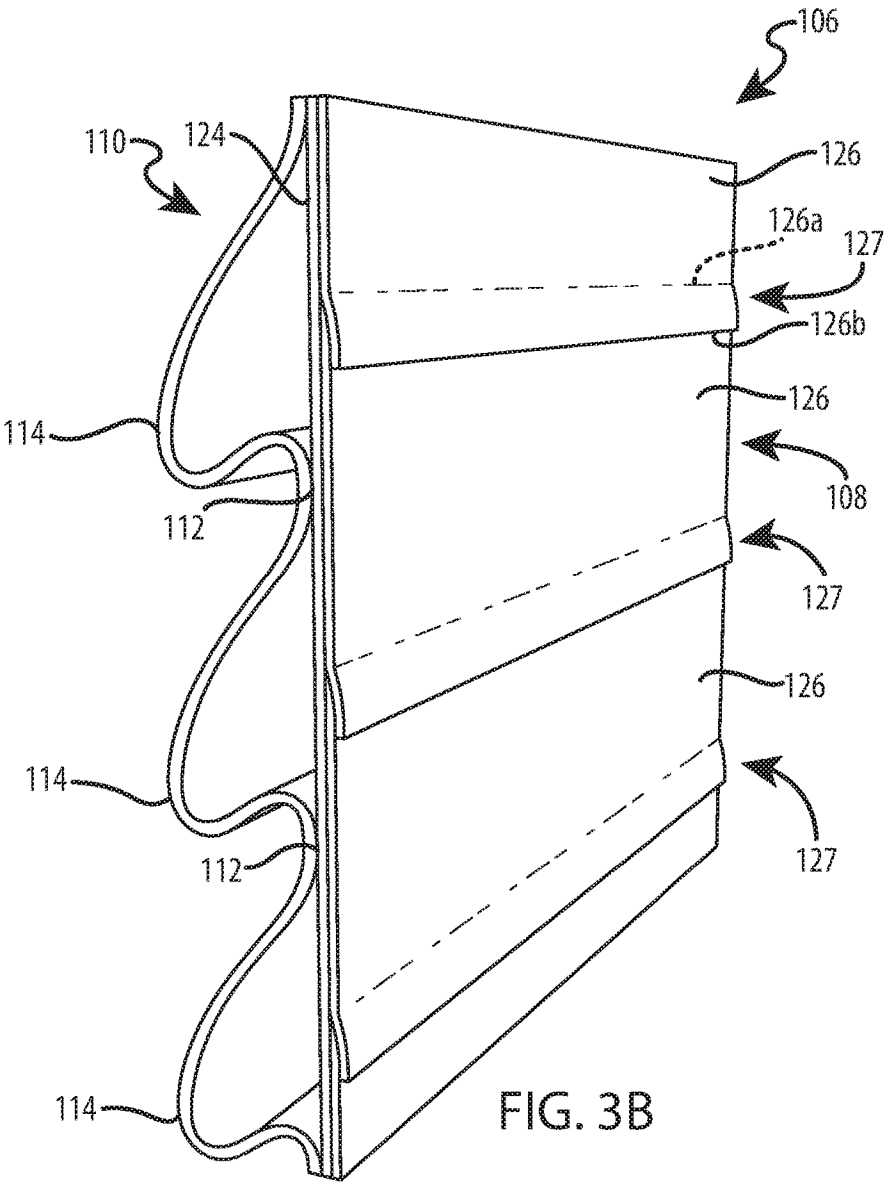
FIG. 3B is an enlarged, fragmentary isometric view of an extended portion of the covering of FIG. 2 in accordance with some embodiments of the present disclosure.
Figure 3A:
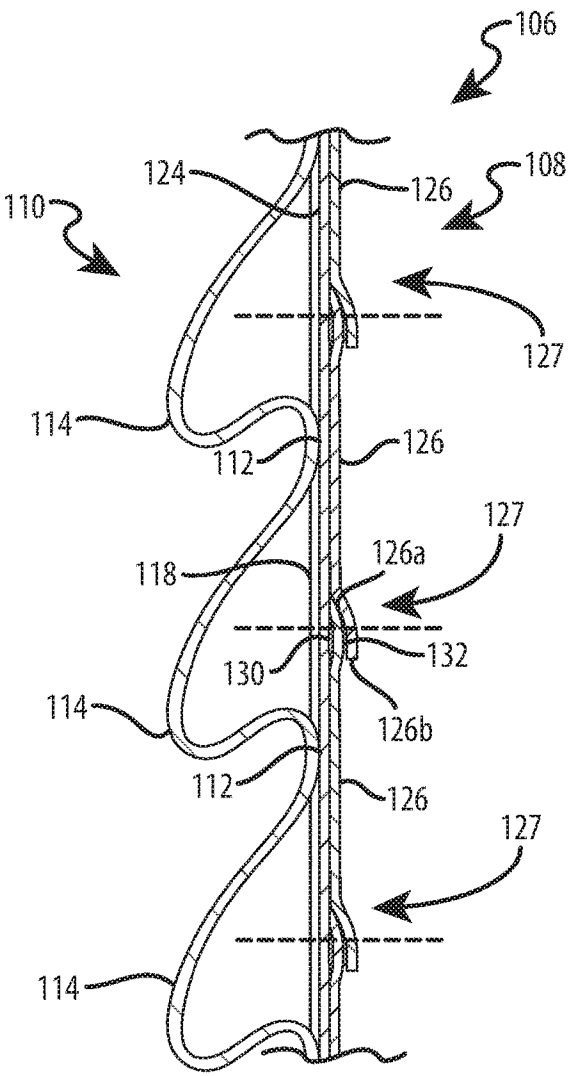
FIG. 3A is an enlarged, fragmentary cross-sectional view of an extended portion of the covering of FIG. 1 taken along line 3A-3A of FIG. 2 in accordance with some embodiments of the present disclosure.

Referring to FIGS. 3A and 3B, the stiffened regions 127 may extend generally parallel to the lines of attachment 112. The stiffened regions 127 may alternate with the lines of attachment 112 along the length dimension of the rear layer 108. Each stiffened portion 127 may be located vertically between two adjacent lines of attachment 112. Each stiffened portion 127 may be located vertically equidistant between two adjacent lines of attachment 112.

Figure 6:
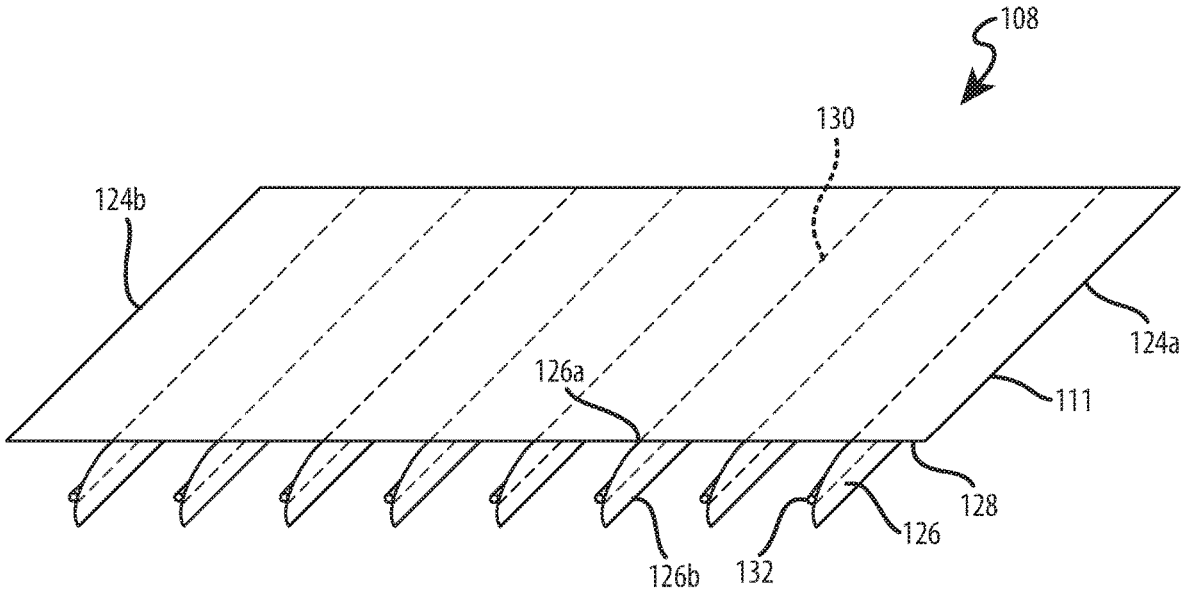
FIG. 6 is a front isometric view of a rear layer of the covering of FIG. 1 having a plurality of strips of material attached along upper edges to a support sheet in accordance with some embodiments of the present disclosure.
Figure 7:
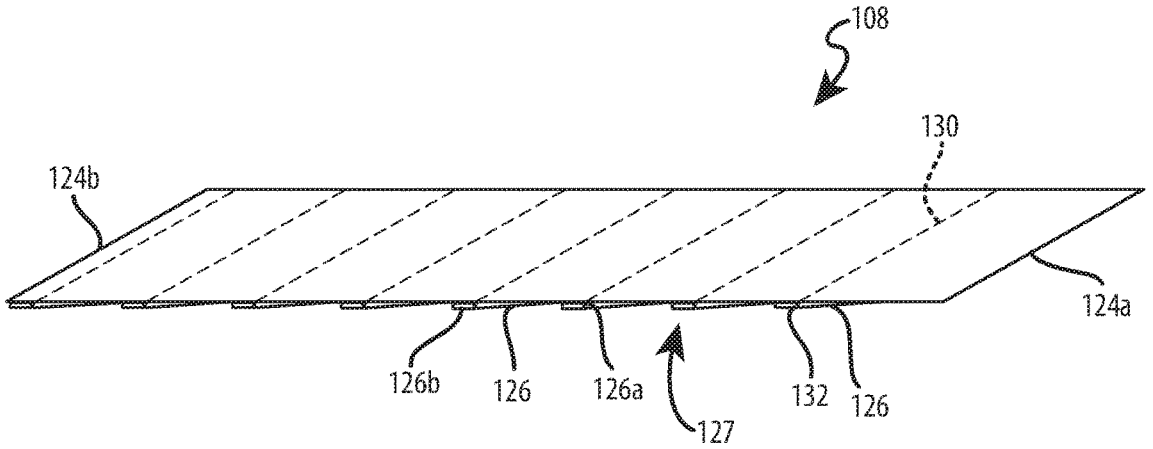
FIG. 7 is a front isometric view of the rear layer of FIG. 6, with a lower edge of the strips of materials attached to the upper edges of immediately subjacent strips of materials in accordance with some embodiments of the present disclosure.

Referring to FIGS. 6 and 7, the rear layer 108 of the shade 106 may be a composite or laminate structure, which may be permanently assembled by heat, pressure, welding, or adhesives. The rear layer 108 may include a support sheet 124 and a plurality of strips of material or strips of material 126. The support sheet 124 may be attached to the head rail 102 along an upper edge 124*a* and may be attached to the bottom rail 104 along a lower edge 124*b*. When the shade 106 is in the extended position of FIG. 1, the support sheet 124 may be pulled taut by the bottom rail 104 into a flat, planar configuration.

The strips of material 126 may be attached to the support sheet 124 (e.g., by adhesive, knitting, sewing, ultrasonic bonding, or other suitable attachment elements or methods) and may bias the support sheet 124 to bend or fold in a rearwardly direction. The strips of material 126 may overlap one another to form the stiffened regions 127, which may have increased rigidity or stiffness relative to support sheet 124. The stiffened regions 127 may be formed at the interface between contiguous strips of material 126 and may extend along the width dimension of the rear layer 108 in substantially parallel relationship to the bottom rail 104. The stiffened regions 127 may cause the support sheet 124 to bend or fold in a rearwardly direction during retraction of the shade 106, resulting in a predictable stacking of the support sheet 124.

With continued reference to FIGS. 6 and 7, the strips of material 126 may be laminated to a rear face 128 of the support sheet 124 in opposing relationship to the front layer 110. The upper edges 126*a* of the strips of material 126 may extend along the width dimension of the rear layer 108 in substantially parallel relationship to the bottom rail 104 and may be attached to the rear face 128 along lines of attachment 130, which may be vertically-spaced apart from each other by uniform intervals. The lower edges 126*b* of the strips of material 126 may be substantially parallel to the upper edges 126*a* of the strips of material 126 and may overlap the upper edges 126*a* of immediately subjacent strips of material 126. The overlapping configuration of the strips of material 126 may conceal or cover the rear face 128 of the support sheet 124. In some implementations, the lines of attachment 130 are vertically-spaced apart at about 4-inch intervals, and the distance between the upper and lower edges 126*a*, 126*b* of the strips of material is about 4.25 inches, which may result in a vane overlap of about 0.25 inches. Heat, pressure, welding, adhesive, or a combination thereof may be applied to the support sheet 124, the strips of material 126, or both to laminate the strips of material 126 to the support sheet 124. When laminated to the support sheet 124, the strips of material 126 may have a machine direction that extends horizontally across the face 128 of the support sheet 124, which may facilitate constructing coverings with larger width dimensions. For example, in some implementations, the rear layer 108 may have a width dimension of about 105 inches to accommodate larger architectural openings.

Referring to FIGS. 6 and 7, the lower edges 126*b* of the strips of material 126 may be attached to the upper edges 126*a* of immediately subjacent strips of material 126 with reinforcement beads 132, which may be an adhesive. As shown in FIG. 5, the reinforcement beads 132 may extend along the lower edges 126*b* of the strips of material 126 in substantially parallel relationship to the lower edges 126*b*. When the strips of material 126 are attached to the support sheet 124, the reinforcement beads 132 and the lines of attachment 130 may be aligned with each another along opposing faces of the upper edges 126*a* of the strips of material 126. In some implementations, the reinforcement beads 132 are formed of a hot-melt adhesive, a pressure-sensitive adhesive, or a combination thereof. In these implementations, the reinforcement beads 132 may be selectively activated upon application of temperature, pressure, or a combination thereof. The portions of the strips of material 126 defined between the upper and lower edges 126*a*, 126*b* may move in unison with the support sheet 124.

The stiffened regions 127 of the rear layer 108 may be defined by the overlapping material of the strips of material 126, the lines of attachment 130, the reinforcement beads 132, or a combination thereof. The stiffened regions 127 may increase the rigidity or stiffness of the rear layer 108 at predetermined, vertically-spaced intervals. Referring to FIGS. 2, 3A, 3B, and 7, the stiffened regions 127 may extend along the width dimension of the rear layer 108 in generally parallel relationship to the bottom rail 104 and may cause the rear layer 108 to stack predictably in one direction, with the stiffened regions 127 disposed at or near the apexes or tips of the loops of material 123. During retraction of the shade 106, the stiffened regions 127 may bias the rear layer 108 in a rearwardly direction, generally opposite the forwardly-directed bias of the front layer 110. As such, during retraction of the shade 106, the bottom rail 104 may be raised by the lift elements 118 without interference from the front or rear layers 108, 110, resulting in a shade 106 that may be stacked about a generally centrally-located bottom rail 104 and generally centrally-located lift elements 118 in a consistent, repeatable manner. The stiffened regions 127 may cause localized bending or a hinge effect (e.g., form a living hinge) along opposing edges of the stiffened regions 127 extending along the width dimension of the rear layer 108. In other words, the stiffened regions 127 may create discrete, pre-defined bending or folding lines adjacent to the stiffened regions 127. The transition of the rear layer 108 from being stiff at the stiffened regions 127 to being flexible along a discrete line defined at the edges of the stiffened regions 127 encourages the rear layer 108 to bend or fold at the discrete lines to provide a predictable folding location when stacked.

Referring to FIGS. 3A and 3B, the front layer 110 may be attached to the support sheet 124 along the lines of attachment 112, which may form an alternating relationship with the lines of attachment 130 of the strips of material 126 to the support sheet 124. In other words, each line of attachment 112 may be positioned vertically between two consecutive lines of attachment 130 when the shade 106 is in an extended position. In some implementations, the lines of attachment 112 may be vertically centered along the strips of material 126 (see FIGS. 3A and 3B). To facilitate a substantially even distribution of the loops of material 114, 123 about the bottom rail 104, the weight of the loops of material 114 of the front layer 110 may be substantially equivalent to the weight of the loops of material 123 of the rear layer 108. The weight equivalency of the loops of material 114, 123 may facilitate the vertical alignment of the lines of attachment 112 with a vertical centerline of the bottom rail 104. The forwardly and rearwardly extending loops of material 114, 123 may balance the weight of the stacked shade 106 and keep the bottom rail 104 from tilting. In some embodiments, the shade 106 may be slightly off-balanced and a heavier or counterbalanced bottom rail 104 may be used to reduce or minimize tilt of the bottom rail 104.

To assemble the shade 106, the strips of material 126 may be attached to the support sheet 124 along lines of attachment 130 at vertically-spaced intervals. In some implementations, the upper edge 126*a* of each strip of material 126 is attached to the support sheet 124, such as by adhesive, knitting, stitching, or any other suitable attachment element or method. The lower edge 126*b* of each strip of material 126 may be overlapped with the upper edge 126*a* of an immediately subjacent strip of material 126 and may be attached to the upper edge 126*a* with a reinforcement bead 132. The support sheet 124 and the strips of material 126 may be permanently attached to one another during a lamination process to ensure the support sheet 124 moves in unison with the strips of material 126. The attachment of the strips of material 126 to the support sheet 124 may be performed in an assembly machine in which the strips of material 126 are moved across the rear face 128 of the support sheet 124 in the width direction of the support sheet 124. The travel direction of the strips of material 126 may be generally orthogonal to the travel direction of the support sheet 124.

The front layer 110 may be attached to the support sheet 124 vertically between the lines of attachment 130. In some implementations, the front layer 110 may be attached to the support sheet 124 along vertically-spaced, horizontally-extending lines of attachment 112, which may be vertically centered between the lines of attachment 130 of the strips of material 126 to the support sheet 124. The attachment of the front layer 110 to the support sheet 124 may be performed in an assembly machine in which the front layer 110 is moved along the front face 111 of the rear layer 108 in the length direction of the rear layer 108. The travel direction of the front layer 110 may be generally parallel to the travel direction of the support sheet 124. The front layer 110 may travel at a faster speed than the support sheet 124, resulting in the formation of the loops of material 114 between the lines of attachment 112 of the front layer 110 to the support sheet 124. The lines of attachment 112, 130 may be activated by applying heat, pressure, or both to the lines of attachment 112, 130. The lift cords 118 may be positioned between the front layer 110 and the support sheet 124 and may be slidably disposed through gaps 122 formed in the lines of attachment 112. Upper ends of the lift cords 118 may be attached to the head rail 102. Lower ends of the lift cords 118 may be attached to the bottom rail 104. The support sheet 124 may be attached to the head rail 102 along the upper edge 124*a* of the support sheet 124 and to the bottom rail 104 along the lower edge 124*b* of the support sheet 124.

The shade 106 may be constructed of substantially any type of material. For example, the layers 108, 110 of the shade may be constructed from natural and/or synthetic materials, including fabrics, polymers, and/or other suitable materials. Fabric materials may include woven, non-woven, knits, or other suitable fabric types. In some implementations, the front layer 110 is constructed from a solid woven or knit fabric material. In some implementations, the front layer 110 is constructed from a 28 gauge, 20/1 semi-dull polyester knit fabric material. In some implementations, the support sheet 124 is constructed from a sheer knit fabric. In some implementations, the support sheet 124 has a thickness of 28 gauge. In some implementations, the strips of material 126 are constructed of a nonwoven fabric material, which may be formed using a spunlace process. In some implementations, the strips of material 126 are formed of a light-dimming fabric, such as Bon Soir™. In some implementations, the film has a thickness of 36 gauge.

The layers 108, 110 may have any suitable level of light transmissivity. For example, the layers 108, 110 may be constructed of transparent, translucent, and/or opaque materials to provide a desired ambience or decor in an associated room. In some implementations, the front layer 110 is an opaque, solid-face knit or woven material. In some implementations, the support sheet 124, the strips of material 126, or both are opaque and block or prevent light transmission through the shade 106. In some implementations, the strips of material 126 are colored black with paint or laminated with a light-blocking film. The laminated film may be disposed on either or both sides of the strips of material 126. In some implementations, one or both faces of the strips of material 126 may be laminated with a smooth flexible material, such as Mylar™.

The present disclosure generally provides a sheet of flexible material that consistently and predictably gathers in one predetermined direction when one edge of the sheet of material is moved toward an opposite or fixed edge of the sheet of material. The biasing of the sheet of material to gather in one predetermined direction may be achieved by securing strips of materials to the face of the sheet of material facing the direction in which it is desired to have the sheet of material gather. The strips of material may overlap one another and may be attached to the sheet of material along substantially parallel lines of attachment. The strips of material may be substantially parallel with each other and with the edges of the sheet, which may be moved toward each other to cause the sheet to gather about a moveable bottom rail. The overlapping strips of material may be attached to the flexible sheet with adhesive, ultrasonic bonding, or the like. The overlapping strips of material may increase the stiffness of the flexible sheet along the width dimension of the flexible sheet at vertically-spaced intervals, which may result in a predictable bending or folding of the sheet at the stiffened areas. The predictable gathering may be advantageous, as sheets of flexible material tend to randomly bunch when gathered, which may adversely interfere with the operation of the covering. The sheet of material may be gathered in loops when the sheet is moved from an extended position to a retracted position by moving one edge of the sheet toward an opposite edge of the sheet.

If it is desired to gather the sheet in a rearward direction, the strips of material may be attached to the rear face of the sheet with substantially straight lines of attachment that extend generally parallel to the top and bottom edges of the sheet and to one another. By raising a bottom rail, the bottom edge of the sheet of material may be raised toward the top edge of the material, thereby causing the sheet of material to gather therebetween, and due to the strips of material attached to the rear face of the sheet, the gathering is in a rearward direction. When incorporated into a Roman shade having a sheet of material with strips of material attached along a rear face of the sheet and a looped material extending off a front face of the sheet, the loops on the front face remain drooped in a forward direction while the sheet is gathered consistently and uniformly in a rearward direction so as to not inhibit the operation of the lift elements in their sliding movement through the covering or so as to not form wrinkles in the looped material, which might be undesirable from an aesthetic standpoint.

The foregoing description has broad application. While the provided examples describe a Roman shade, it should be appreciated that the concepts disclosed herein may equally apply to any type of shade that includes a sheet of material that is stacked from a flat, planar configuration. While the provided examples describe the support sheet being laminated with overlapping strips of material, the support sheet may be laminated with strips of material disposed in an edge-to-edge relationship. Further, while the provided examples describe the support sheet being laminated with strips of material, the support sheet may be attached to a single, continuous sheet of material with spaced lines of attachment, which may form stiffened regions or battens. Moreover, the covering may be mounted in an architectural opening in various orientations, such as with the front layer facing the room side or the street side of the building structure. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

The invention claimed is:

1. A covering for an architectural opening, comprising:

a head rail;

a bottom rail;

a first sheet of material including a support sheet and a plurality of strips of material attached to a first side of the support sheet along lines of attachment, the support sheet extending from the head rail to the bottom rail, the first sheet of material including stiffened areas extending horizontally along the first side, wherein when the covering is moved from an extended position to a retracted position, each of the stiffened areas causing the first sheet of material to bend in loops of material with the stiffened areas being disposed at apexes of the loops of material, the loops of material of the first sheet of material extending in a first direction;

a second sheet of material attached to a second side of the support sheet, wherein the second sheet of material forms loops of material when the covering is in the extended position, the loops of material of the second sheet of material extending in a second direction different from the first direction; and a set of lift elements operative to raise the bottom rail toward the head rail.

2. The covering of claim 1, wherein the support sheet is coupled to the second sheet of material along lines of attachment, each line being positioned between adjacent stiffened areas.

3. The covering of claim 1, wherein each of the plurality of strips of material include an upper edge and a lower edge, the upper edge of each strip of material is attached to the support sheet, the lower edge of each strip of material overlaps with the upper edge of an adjacent strip of material.

4. The covering of claim 1, wherein the second sheet of material is attached to the support sheet of the first sheet of material along lines of attachment, the lines of attachment for attaching the second sheet to the support sheet being positioned between the lines of attachment for attaching the strip of material to the support sheet.

5. The covering of claim 1, wherein the loops of material of the first sheet of material define a vertical column of horizontally-extending cells when the covering is in the retracted position.

6. The covering of claim 1, wherein:

the loops of material of the second sheet of material gather in a first vertical stack along a first side of the bottom rail when the covering is in the retracted position; and the loops of material of the first sheet of material gather in a second vertical stack along a second side of the bottom rail when the covering is in the retracted position.

7. The covering of claim 1, wherein the weight of the loops of material of the first sheet of material is substantially equivalent to the weight of the loops of material of the second sheet of material to balance the covering when in the retracted position.

8. The covering of claim 1, wherein the first sheet of material is configured to hang in a substantially flat, vertical plane when the covering is in the extended position.

9. The covering of claim 1, wherein the first sheet of material including stiffened areas includes a single stiffened area positioned between adjacent loops of material.

10. The covering of claim 1, wherein the support sheet is coupled to the second sheet of material along lines of attachment that alternate with the stiffened areas along a length dimension of the support sheet.

11. The covering of claim 10, wherein each line of attachment of the lines of attachment between the support sheet and the second sheet of material is centered between adjacent stiffened areas of the stiffened areas.

12. The covering of claim 10, wherein each line of attachment of the lines of attachment between the support sheet and the second sheet of material is positioned between adjacent stiffened areas of the stiffened areas.

13. The covering of claim 12, wherein each line of attachment of the lines of attachment between the support sheet and the second sheet of material is positioned equidistant between adjacent stiffened areas of the stiffened areas.

14. The covering of claim 1, wherein the first sheet of material is opaque.

15. The covering of claim 14, wherein the first sheet of material is at least painted partially black.

16. The covering of claim 14, wherein the first sheet of material is laminated with a light-blocking film.

17. The covering of claim 14, wherein the second sheet of material is formed from an opaque material.

18. A covering for an architectural opening, comprising:

a head rail;

a bottom rail;

a sheet of material extending from the head rail to the bottom rail, the sheet of material including multiple strips of material, each of the multiple strips of material include an upper edge and a lower edge, the lower edge of each strip of material overlaps with the upper edge of an adjacent strip of material to form stiffened areas extending horizontally along a side of the sheet of material, the stiffened areas being spaced apart from one another along a length dimension of the sheet of material; and a set of lift elements operative to move the covering between an extended position and a retracted position;

wherein when the covering is moved from the extended position to the retracted position:

each stiffened area biases the sheet of material to bend along edges of the stiffened areas so that the sheet of material gathers in loops of material directed towards the stiffened areas; and the loops of material are stacked in a vertical column when the covering is in the retracted position.

19. The covering of claim 18, wherein the sheet of material is opaque.

20. The covering of claim 18, wherein at least one face of the sheet of material is metallized or coated with a light-blocking material.

21. The covering of claim 18, wherein the sheet of material is configured to hang in a substantially flat, vertical plane when the covering is in the extended position.

22. The covering of claim 18, wherein each loop of material of the loops of material includes a top portion and a bottom portion, the stiffened areas being spaced from the top and bottom portions.

23. The covering of claim 18, wherein the sheet of material comprises a first sheet of material, and further comprising a second sheet of material attached to the first sheet of material, wherein the second sheet of material forms loops of material directed opposite the loops of material of the first sheet of material when the covering is in the retracted position.

24. The covering of claim 23, wherein the second sheet of material is attached to the first sheet of material along lines of attachment that alternate with the stiffened areas along a length dimension of the first sheet of material.

25. The covering of claim 23, wherein when the covering is in the retracted position:

the loops of material of the first sheet of material gather in a first vertical stack; and the loops of material of the second sheet of material gather in a second vertical stack.

26. The covering of claim 18, wherein the sheet of material is formed from an opaque material.

27. The covering of claim 26, wherein the side of the sheet of material is a first side so that the sheet of material extends horizontally along the first side of the first sheet of material.

28. The covering of claim 27, further comprising a second sheet of material attached to a second side of the sheet of material, wherein the second sheet of material forms directed loops of material when the covering is in the extended position.

29. The covering of claim 26, wherein the stiffened areas are disposed at apexes of the directed loops of material.

30. The covering of claim 29, wherein each directed loop of material includes a single stiffened area.

31. A covering for an architectural opening, comprising:

a first sheet of flexible material having a front face and a rear face; and multiple strips of material extending along a width dimension of the first sheet, the multiple strips of material coupled to and contiguous with one of the front and rear face of the first sheet, wherein the multiple strips of material overlap one another to form stiffened regions spaced apart from one another along a length dimension of the first sheet, each stiffened region biasing the first sheet to bend along edges of the stiffened regions so that the first sheet gathers in loops of material directed towards the stiffened regions.

32. The covering of claim 31, further comprising a second sheet of flexible material, the multiple strips of material being coupled to the rear face of the first sheet, the second sheet being coupled to the front face of the first sheet, the second sheet being arranged and configured to form directed loops of material when the covering is in an extended position.

33. The covering of claim 32, wherein the second sheet is coupled to the front face of the first sheet along a set of vertically-spaced lines, the set of vertically-spaced lines being disposed vertically between the stiffened regions.

34. The covering of claim 33, wherein the second sheet forms forwardly-directed loops of material when the covering is in an extended position.

35. The covering of claim 33, wherein the set of vertically-spaced lines are positioned equidistant between the stiffened regions.

36. The covering of claim 31, further comprising:

a head rail;

a bottom rail; and a set of lift elements operative to raise the bottom rail toward the head rail;

wherein the first sheet extends from the head rail to the bottom rail; and wherein, when the covering is moved from the extended position to a retracted position, the first sheet gathers in loops of material that are rearwardly-directed and have apexes defined along or adjacent the stiffened regions.

37. The covering of claim 36, wherein the loops of material of the first sheet define a vertical column of horizontally-extending cells when the covering is in a retracted position.

* * * * *